US007927181B2

(12) United States Patent
Blalock

(10) Patent No.: US 7,927,181 B2
(45) Date of Patent: Apr. 19, 2011

(54) APPARATUS FOR REMOVING MATERIAL FROM MICROFEATURE WORKPIECES

(75) Inventor: Guy T. Blalock, Eagle, ID (US)

(73) Assignee: Micron Technology, Inc., Boise, ID (US)

( * ) Notice: Subject to any disclaimer, the term of this patent is extended or adjusted under 35 U.S.C. 154(b) by 317 days.

(21) Appl. No.: 12/204,017

(22) Filed: Sep. 4, 2008

(65) Prior Publication Data

US 2009/0004951 A1 Jan. 1, 2009

Related U.S. Application Data

(62) Division of application No. 11/217,269, filed on Aug. 31, 2005, now Pat. No. 7,438,626.

(51) Int. Cl.
*B24B 49/00* (2006.01)
*B24B 51/00* (2006.01)

(52) U.S. Cl. ..... 451/5; 451/6; 451/8; 451/9; 451/910

(58) Field of Classification Search ..... 451/6, 8, 451/9, 10, 11, 285, 286, 287, 288, 289, 290, 451/910, 5
See application file for complete search history.

(56) References Cited

U.S. PATENT DOCUMENTS 5,081,796 A 1/1992 Schultz
5,232,875 A 8/1993 Tuttle et al.
5,234,867 A 8/1993 Schultz et al.
5,240,552 A 8/1993 Yu et al.
5,244,534 A 9/1993 Yu et al.
5,245,790 A 9/1993 Jerbic
5,245,796 A 9/1993 Miller et al.
RE34,425 E 11/1993 Schultz
5,421,769 A 6/1995 Schultz et al.
5,433,651 A 7/1995 Lustig et al.
5,449,314 A 9/1995 Meikle et al.
5,486,129 A 1/1996 Sandhu et al.
5,514,245 A 5/1996 Doan et al.
5,533,924 A 7/1996 Stroupe et al.
5,540,810 A 7/1996 Sandhu et al.
5,609,718 A 3/1997 Meikle
5,618,381 A 4/1997 Doan et al.
5,618,447 A 4/1997 Sandhu
5,643,060 A 7/1997 Sandhu et al.
(Continued)

OTHER PUBLICATIONS

Kondo, S. et al., "Abrasive-Free Polishing for Copper Damascene Interconnection," Journal of the Electrochemical Society, vol. 147, No. 10, pp. 3907-3913, 2000.

*Primary Examiner* — Timothy V Eley
(74) *Attorney, Agent, or Firm* — Perkins Coie LLP

(57) ABSTRACT

Machines and systems for removing materials from microfeature workpieces using fixed-abrasive mediums. One embodiment of a method for removing material from a microfeature workpiece comprises rubbing the workpiece against a surface of a fixed-abrasive medium having a matrix and abrasive particles attached to the matrix, and sensing a parameter indicative of frictional force at an interface between the workpiece and the surface of the fixed-abrasive medium. This method continues by moving at least one of the workpiece and the fixed-abrasive medium relative to each other in a direction transverse to the interface based on the parameter. For example, the workpiece and/or the fixed-abrasive medium can be vibrated or oscillated to reduce the frictional force and/or maintain a desired relative velocity between the workpiece and the fixed-abrasive medium.

28 Claims, 4 Drawing Sheets

U.S. PATENT DOCUMENTS 5,658,183 A 8/1997 Sandhu et al.
5,658,190 A 8/1997 Wright et al.
5,664,988 A 9/1997 Stroupe et al.
5,679,065 A 10/1997 Henderson
5,692,950 A 12/1997 Rutherford et al.
5,700,180 A 12/1997 Sandhu et al.
5,702,292 A 12/1997 Brunelli et al.
5,730,642 A 3/1998 Sandhu et al.
5,747,386 A 5/1998 Moore
5,792,709 A 8/1998 Robinson et al.
5,795,495 A 8/1998 Meikle
5,807,165 A 9/1998 Uzoh et al.
5,830,806 A 11/1998 Hudson et al.
5,842,909 A 12/1998 Sandhu et al.
5,851,135 A 12/1998 Sandhu et al.
5,868,896 A 2/1999 Robinson et al.
5,882,248 A 3/1999 Wright et al.
5,893,754 A 4/1999 Robinson et al.
5,895,550 A 4/1999 Andreas
5,934,980 A 8/1999 Koos et al.
5,945,347 A 8/1999 Wright
5,954,912 A 9/1999 Moore
5,958,794 A 9/1999 Bruxvoort et al.
5,967,030 A 10/1999 Blalock
5,972,792 A 10/1999 Hudson
5,980,363 A 11/1999 Meikle et al.
5,981,396 A 11/1999 Robinson et al.
5,994,224 A 11/1999 Sandhu et al.
5,997,384 A 12/1999 Blalock
6,007,407 A 12/1999 Rutherford et al.
6,039,633 A 3/2000 Chopra
6,040,245 A 3/2000 Sandhu et al.
6,054,015 A 4/2000 Brunelli et al.
6,066,030 A 5/2000 Uzoh
6,074,286 A 6/2000 Ball
6,083,085 A 7/2000 Lankford
6,110,820 A 8/2000 Sandhu et al.
6,116,988 A 9/2000 Ball
6,120,354 A 9/2000 Koos et al.
6,125,255 A 9/2000 Litman
6,135,856 A 10/2000 Tjaden et al.
6,139,402 A 10/2000 Moore
6,143,123 A 11/2000 Robinson et al.
6,143,155 A 11/2000 Adams et al.
6,152,808 A 11/2000 Moore
6,176,992 B1 1/2001 Talieh
6,187,681 B1 2/2001 Moore
6,191,037 B1 2/2001 Robinson et al.
6,193,588 B1 2/2001 Carlson et al.
6,200,901 B1 3/2001 Hudson et al.
6,203,404 B1 3/2001 Joslyn et al.
6,203,407 B1 3/2001 Robinson
6,203,413 B1 3/2001 Skrovan
6,206,756 B1 3/2001 Chopra et al.
6,210,257 B1 4/2001 Carlson
6,213,845 B1 4/2001 Elledge
6,218,316 B1 4/2001 Marsh
6,224,466 B1 5/2001 Walker et al.
6,227,955 B1 5/2001 Custer et al.
6,234,874 B1 5/2001 Ball
6,234,877 B1 5/2001 Koos et al.
6,234,878 B1 5/2001 Moore
6,237,483 B1 5/2001 Blalock
6,250,994 B1 6/2001 Chopra et al.
6,251,785 B1 6/2001 Wright
6,261,151 B1 7/2001 Sandhu et al.
6,261,163 B1 7/2001 Walker et al.
6,267,650 B1 7/2001 Hembree
6,273,786 B1 8/2001 Chopra et al.
6,273,796 B1 8/2001 Moore
6,276,996 B1 8/2001 Chopra
6,306,012 B1 10/2001 Sabde
6,306,014 B1 10/2001 Walker et al.
6,306,768 B1 10/2001 Klein
6,312,558 B2 11/2001 Moore
6,313,038 B1 11/2001 Chopra et al.
6,328,632 B1 12/2001 Chopra
6,331,488 B1 12/2001 Doan et al.
6,338,667 B2 1/2002 Sandhu et al.
6,350,180 B2 2/2002 Southwick
6,350,691 B1 2/2002 Lankford
6,352,466 B1 3/2002 Moore
6,354,923 B1 3/2002 Lankford
6,354,930 B1 3/2002 Moore
6,358,122 B1 3/2002 Sabde et al.
6,358,127 B1 3/2002 Carlson et al.
6,358,129 B2 3/2002 Dow
6,361,417 B2 3/2002 Walker et al.
6,364,757 B2 4/2002 Moore
6,368,190 B1 4/2002 Easter et al.
6,368,193 B1 4/2002 Carlson et al.
6,368,194 B1 4/2002 Sharples et al.
6,368,197 B2 4/2002 Elledge
6,376,381 B1 4/2002 Sabde
6,383,934 B1 5/2002 Sabde et al.
6,387,289 B1 5/2002 Wright
6,395,620 B1 5/2002 Pan et al.
6,402,884 B1 6/2002 Robinson et al.
6,428,386 B1 8/2002 Bartlett
6,447,369 B1 9/2002 Moore
6,498,101 B1 12/2002 Wang
6,511,576 B2 1/2003 Klein
6,520,834 B1 2/2003 Marshall
6,533,893 B2 3/2003 Sabde et al.
6,547,640 B2 4/2003 Hofmann
6,548,407 B1 4/2003 Chopra et al.
6,579,799 B2 6/2003 Chopra et al.
6,592,443 B1 7/2003 Kramer et al.
6,609,947 B1 8/2003 Moore
6,623,329 B1 9/2003 Moore
6,633,084 B1 10/2003 Sandhu et al.
6,652,764 B1 11/2003 Blalock
6,666,749 B2 12/2003 Taylor
2002/0004365 A1 1/2002 Jeong et al.
2002/0132561 A1 9/2002 Schulz et al.
2002/0187735 A1 12/2002 Nabeya
2004/0043699 A1* 3/2004 Chandrasekaran ..... 451/5
2005/0112998 A1 5/2005 Matsuo et al.
2005/0142987 A1* 6/2005 Kramer et al. ..... 451/5
2007/0049172 A1 3/2007 Blalock

* cited by examiner

APPARATUS FOR REMOVING MATERIAL FROM MICROFEATURE WORKPIECES

CROSS-REFERENCE TO RELATED APPLICATION

This application is a divisional of U.S. patent application Ser. No. 11/217,269, filed Aug. 31, 2005, which is incorporated herein by reference in its entirety.

TECHNICAL FIELD

The present invention relates to removing material from microfeature workpieces using mechanical and chemical-mechanical processes that abrade the surface of the microfeature workpieces.

BACKGROUND

One class of processes for removing materials from microfeature workpieces uses abrasive particles to abrade the workpieces either with or without a liquid solution. For example, mechanical and chemical-mechanical processes (collectively "CMP") remove material from the surface of microfeature workpieces in the production of microelectronic devices and other products. FIG. 1 schematically illustrates a rotary CMP machine 10 with a platen 20, a head 30, and a planarizing pad 40. The CMP machine 10 may also have an under-pad 25 between an upper surface 22 of the platen 20 and a lower surface of the planarizing pad 40. A drive assembly 26 rotates the platen 20 (indicated by arrow F) and/or reciprocates the platen 20 back and forth (indicated by arrow G). Since the planarizing pad 40 is attached to the under-pad 25, the planarizing pad 40 moves with the platen 20 during planarization.

The head 30 has a lower surface 32 to which a microfeature workpiece 12 may be attached, or the workpiece 12 may be attached to a resilient pad 34 in the head 30. The head 30 may be a weighted, free-floating wafer carrier, or the head 30 may be attached to an actuator assembly 36 (shown schematically) to impart rotational motion to the workpiece 12 (indicated by arrow J) and/or reciprocate the workpiece 12 back and forth (indicated by arrow I).

The planarizing pad 40 and a planarizing solution 44 define a planarizing medium that mechanically and/or chemically-mechanically removes material from the surface of the workpiece 12. The planarizing solution 44 may be a conventional CMP slurry with abrasive particles and chemicals that etch and/or oxidize the surface of the microfeature workpiece 12, or the planarizing solution 44 may be a "clean" non-abrasive planarizing solution without abrasive particles. In most CMP applications, abrasive slurries with abrasive particles are used on non-abrasive polishing pads, and clean non-abrasive solutions without abrasive particles are used on fixed-abrasive polishing pads.

To planarize the microfeature workpiece 12 with the CMP machine 10, the head 30 presses the workpiece 12 face-down against the planarizing pad 40. More specifically, the head 30 generally presses the microfeature workpiece 12 against the planarizing solution 44 on a planarizing surface 42 of the planarizing pad 40, and the platen 20 and/or the head 30 moves to rub the workpiece 12 against the planarizing surface 42.

Conventional CMP processes that use abrasive slurries may not produce adequate results because it is difficult to consistently produce a uniformly planar surface across the workpiece. The planarity across the workpiece is a function of several parameters; one such parameter is the distribution of abrasive particles between the workpiece 12 and the planarizing surface 42. The distribution of abrasive particles, however, is difficult to control because the leading edge of the workpiece 12 wipes the planarizing solution 44 from the planarizing surface 42. As a result, there is generally less planarizing solution 44 and thus fewer abrasive particles at center of the workpiece 12 compared to the edge of the workpiece 12. The center region of the workpiece may accordingly have a different removal rate than the edge region.

A useful technique to improve control of the distribution of abrasive particles is to use fixed-abrasive polishing pads. Fixed-abrasive pads have a matrix and abrasive particles attached to the matrix. For example, several existing fixed-abrasive pads have a resin binder and small abrasive particles suspended in the binder in a desired distribution. The abrasive particles at the surface of the fixed-abrasive pad are held in place by the matrix such that the center and the edge of the workpiece consistently experience a well-controlled distribution of abrasive particles.

Fixed-abrasive pads, however, may have several drawbacks. One drawback of using a fixed-abrasive pad is that the workpiece can skip, chatter, and/or stick relative to the surface of the fixed-abrasive pad. This can produce scratches or other defects in the workpiece. Therefore, even though fixed-abrasive pads are promising, additional development is needed to use them for the production of many types of microfeature devices.

DETAILED DESCRIPTION

A. Overview

Figure 1:
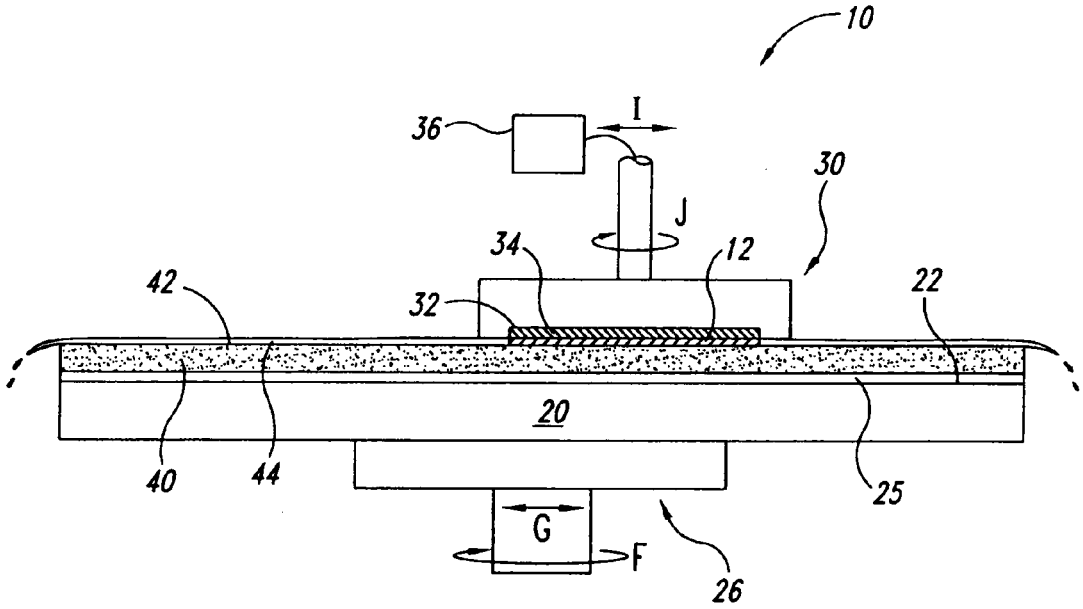
Fig. 1 (Prior Art)
FIG. 1 is a schematic view of a machine with a support, a head, and a polishing pad in accordance with the prior art.

The present invention is directed toward machines and methods for removing materials from microfeature workpieces using fixed-abrasive mediums. Many embodiments of the invention are described in connection with mechanically and/or chemically-mechanically removing materials from microfeature workpieces, but these embodiments can also include back-grinding or other processes that abrade materials from workpieces. As described herein, several embodiments of the invention control the frictional force at the interface between the workpiece and a fixed-abrasive medium to avoid skipping, chatter, sticking, and other undesirable interaction between the workpiece and the fixed-abrasive medium. This is expected to reduce scratches or other defects on the surface of the workpiece that may be associated with the fixed-abrasive particles.

One embodiment of a method for removing material from a microfeature workpiece comprises rubbing the workpiece against a surface of a fixed-abrasive medium having a matrix and abrasive particles attached to the matrix. This method further includes vibrating an interface between the workpiece and the surface of the fixed-abrasive medium while rubbing the workpiece against the surface to maintain a frictional force between the workpiece and the surface in a desired range.

The vibrating procedure, for example, can comprise generating relative motion between the workpiece and the fixed-abrasive medium in a direction transverse to the interface between the workpiece and the surface of the fixed-abrasive medium. This can be accomplished by oscillating at least one of the workpiece, the fixed-abrasive medium, a head in which the workpiece is held, and/or a support upon which the fixed-abrasive medium is mounted. These components can be oscillated by moving an actuator at a frequency that maintains the frictional force between the workpiece and the surface in the desired range. In other embodiments, the vibration procedure can comprise reducing a down-force applied to the workpiece. The vibrating procedure can further comprise controlling the frictional force from exceeding a level at which deceleration between the workpiece and the surface exceeds a limit, or the vibrating procedure can further comprise controlling the friction force from exceeding a level at which a relative velocity between the workpiece and the fixed-abrasive medium falls below a limit.

Another embodiment of a method for removing material from a microfeature workpiece comprises rubbing the workpiece against a fixed-abrasive medium having a matrix and abrasive particles attached to the matrix such that the abrasive particles are located at an interface between the workpiece and the fixed-abrasive medium. This method further includes oscillating at least one of the workpiece, the fixed-abrasive medium, the head at which the workpiece is held, and/or a support upon which the fixed-abrasive medium is mounted to control a frictional force at the interface between the workpiece and the fixed-abrasive medium. Many embodiments of the method are performed on a microfeature workpiece having features with critical dimensions not greater than 1 μm (e.g., 30-120 nanometers).

Another embodiment of a method for removing material from a microfeature workpiece comprises rubbing the workpiece against a surface of a fixed-abrasive medium having a matrix and abrasive particles attached to the matrix, and sensing a parameter indicative of frictional force at an interface between the workpiece and the surface of the fixed-abrasive medium. This method continues by moving at least one of the workpiece and the fixed-abrasive medium relative to each other in a direction transverse to the interface based on the parameter. For example, the workpiece and/or the fixed-abrasive medium can be vibrated or oscillated to reduce the frictional force and/or maintain a desired relative velocity between the workpiece and the fixed-abrasive medium.

Still another method of removing material from a microfeature workpiece in accordance with the invention comprises rubbing the workpiece against a surface of a fixed-abrasive medium having a matrix and abrasive particles attached to the matrix, and sensing a parameter indicative of frictional force at the interface between the workpiece and the surface of the fixed-abrasive medium. This embodiment of the method continues by controlling a frictional force between the workpiece and the fixed-abrasive medium to prevent the frictional force from exceeding a static frictional force at which the workpiece skips on the surface of the fixed-abrasive medium.

Additional aspects of the invention are directed toward systems for removing material from microfeature workpieces. One embodiment of such a system comprises a support, a fixed-abrasive medium on the support, and a head configured to rub a microfeature against the surface of the fixed-abrasive medium. The system further includes an actuator operatively coupled to at least one of the support, the fixed-abrasive medium, and/or the head. The system further includes a controller coupled to the actuator. The controller comprises a computer-operable medium containing instructions that cause the actuator to vibrate at an interface between the workpiece and the surface of the fixed-abrasive medium to maintain a frictional force between the workpiece and the surface within a desired range.

Another system for removing material from a microfeature workpiece comprises a support, a fixed-abrasive medium on the support, a head configured to rub a microfeature workpiece against the surface of the fixed-abrasive medium, and an actuator operatively coupled to at least one of the support, the fixed-abrasive medium, and/or the head. This system further includes a controller coupled to the actuator. The controller in this embodiment comprises a computer-operable medium containing instructions that cause the actuator to oscillate at least one of the workpiece and the fixed-abrasive medium relative to each other to control a frictional force at an interface between the workpiece and the fixed-abrasive medium.

Still another system for removing material from a microfeature workpiece in accordance with the invention comprises a support, a fixed-abrasive medium on the support, a head configured to rub a microfeature workpiece against the fixed-abrasive medium, an actuator operatively coupled to at least one of the support, the fixed-abrasive medium, and/or the head, and a sensor configured to sense a parameter relative to a frictional force between the workpiece and the surface of the fixed-abrasive medium. This system further includes a controller that comprises a computer-operable medium containing instructions which cause the actuator to move at least one of the workpiece and the fixed-abrasive medium relative to each other in a direction transverse to the interface based on the parameter detected by the sensor.

FIGS. 2-8 illustrate several systems and methods for removing materials from microfeature workpieces in accordance with selected embodiments of the invention. Specific details of the invention are set forth in the following description and in FIGS. 2-8 to provide a thorough understanding of these embodiments of the invention. One skilled in the art, however, will understand that the present invention may have additional embodiments, or that other embodiments of the invention may be practiced without several of the specific features explained in the following description. The term "microfeature workpiece" is used throughout to include substrates upon which and/or in which microelectronic devices, micromechanical devices, data storage elements, optics, and other features are fabricated. For example, microfeature workpieces can be semiconductor wafers, glass substrates, dielectric substrates, or many other types of substrates. Many features on such microfeature workpieces have critical dimensions less than or equal to 1 μm, and in many applications the critical dimensions of the smaller features are less than 0.25 μm or even less than 0.1 μm. Furthermore, the terms "planarization" and "planarizing" mean forming a planar surface, forming a smooth surface (e.g., "polishing"), or otherwise removing materials from workpieces. Where the context permits, singular or plural terms may also include the plural or singular term, respectively. Moreover, unless the word "or" is expressly limited to mean only a single item exclusive from other items in reference to a list of at least two items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same features and/or types of other features and components are not precluded.

B. Systems and Methods for Removing Materials from Workpieces

Figure 2:
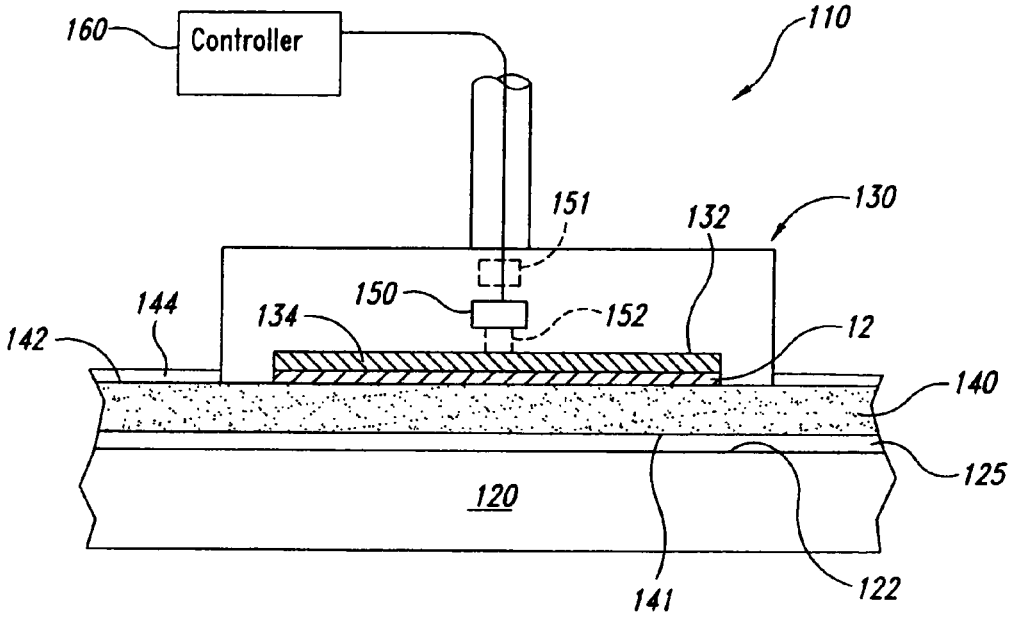
FIG. 2 is a schematic view of a machine with a support, a head, and a fixed-abrasive medium for removing material from a microfeature workpiece in accordance with one embodiment of the invention.

FIG. 2 is a schematic view of a machine 110 with a support 120, a head 130, and a fixed-abrasive medium 140 in accordance with one embodiment of the invention. The machine 110 may also have an under-pad 125 between an upper surface 122 of the support 120 and a lower surface 141 of the fixed-abrasive medium 140. In the illustrated embodiment, the head 130 has a lower surface 132 in a retaining cavity and a resilient pad 134 in the retaining cavity. A microfeature workpiece 12 can be attached to the resilient pad 134, or in other embodiments, the workpiece 12 can be attached to the lower surface 132.

The fixed-abrasive medium 140 has a matrix and a plurality of abrasive-particles retained in the matrix. The matrix typically includes a binder that holds the abrasive particles in place such that abrasive particles at a bearing surface 142 of the fixed-abrasive medium 140 are fixed in a desired distribution. Suitable fixed-abrasive mediums are described in U.S. Pat. Nos. 6,007,407; 5,692,950; and 5,958,794, which are incorporated herein by reference in their entirety. The fixed-abrasive medium 140 can be used dry, with de-ionizing water, and/or a planarizing solution 144 that includes chemicals for chemically controlling aspects of removing material from the workpiece. The planarizing solution 144, for example, can include chemicals that etch and/or oxidize the surface of the workpiece. In certain embodiments, the planarizing solution 144 can also include abrasive particles in addition to the abrasive particles fixed to the matrix in the fixed-abrasive medium 140.

The machine 110 further includes an actuator 150 for imparting relative motion between the workpiece 12 and the fixed-abrasive medium 140. One embodiment of the actuator 150 vibrates an interface between the workpiece 12 and the fixed-abrasive medium 140 to maintain a frictional force between the workpiece 12 and the bearing surface 142 within a desired range while the workpiece 12 rubs against the fixed-abrasive medium 140. Another embodiment of the actuator 150 oscillates at least one of the workpiece 12, the fixed-abrasive medium 140, the head 130, and/or the support 120 to control the frictional force at the interface between the workpiece 12 and the fixed-abrasive medium 140. In still other embodiments, the actuator 150 moves at least one of the workpiece 12 and the fixed-abrasive medium 140 relative to each other in a direction transverse to the interface between the workpiece 12 and the fixed-abrasive medium 140. Several embodiments of methods in accordance with the invention accordingly use the actuator 150 to control the frictional force between the workpiece 12 and the fixed-abrasive medium 140. For example, the actuator 150 can move at least the workpiece 12 and/or the fixed-abrasive medium 140 based on a parameter indicative of the frictional force to prevent the frictional force from exceeding a static frictional force level at which the workpiece 12 skips, chatters, sticks, or otherwise moves in an uncontrolled manner across the surface of the fixed-abrasive medium 140.

The actuator 150 in the embodiment shown in FIG. 2 can be a transducer, such as a piezoelectric transducer, that produces relative motion between the microfeature workpiece 12 and the fixed-abrasive medium 140. The actuator 150 generally produces relative motion between the workpiece 12 and the fixed-abrasive medium 140 in a direction transverse to the interface between the workpiece 12 and the fixed-abrasive medium 140 (e.g., any direction not parallel to the interface), but components of the relative motion can also be parallel to this interface. In one embodiment, the actuator 150 vibrates the head 130 such that the workpiece 12 vibrates with the head 130. In other embodiments, a rod 152 (shown in broken lines) operatively couples the output of the actuator 150 to the resilient pad 134 and/or the workpiece 12 to directly vibrate the workpiece 12. The head 130 can include a damper 151 (shown in broken lines) to reduce movement of the head 130 while the rod 152 vibrates the microfeature workpiece 12. The damper 151 can be a bladder, foam, or other device to dampen the movement of the head 130.

The machine 110 operates by rubbing the workpiece 12 against the bearing surface 142 of the fixed-abrasive medium 140 and activating the actuator 150 to move the workpiece 12 relative to the fixed-abrasive medium 140. The actuator 150 is controlled by a controller 160 having a computer-operable medium with instructions that cause the actuator 150 to impart the relative motion between the workpiece 12 and the fixed-abrasive medium 140. The controller 160, for example, can include computer-operable instructions that cause the actuator 150 to oscillate at a frequency that maintains the frictional force between the workpiece 12 and the bearing surface 142 of the fixed-abrasive medium 140 within a desired range. More specifically, the controller 160 can operate the actuator 150 to control the frictional force from exceeding a level at which deceleration between the workpiece 12 and the bearing surface 142 exceeds a deceleration limit. In another embodiment, the controller 160 can operate the actuator 150 to control the frictional force from exceeding a level at which the relative velocity between the workpiece 12 and the fixed-abrasive medium 140 falls below a threshold limit.

One advantage of several embodiments of the machine 110 is that the relative motion between the workpiece 12 and the fixed-abrasive medium 140 is expected to reduce the probability that the wafer will skip, chatter, stick, or otherwise move in an undesired manner across the surface 142 of the fixed-abrasive medium 140. It is believed that vibrating the workpiece 12 and/or the fixed-abrasive medium 140 varies the down-force in a manner that prevents the relative velocity between the workpiece 12 and the fixed-abrasive medium 140 from dropping below a threshold at which the workpiece skips or sticks to the fixed-abrasive medium 140 (e.g., the static friction threshold). As a result, it is expected that several embodiments of the invention will reduce scratches or other defects commonly associated with removing materials from workpieces using fixed-abrasive mediums.

Figure 3:
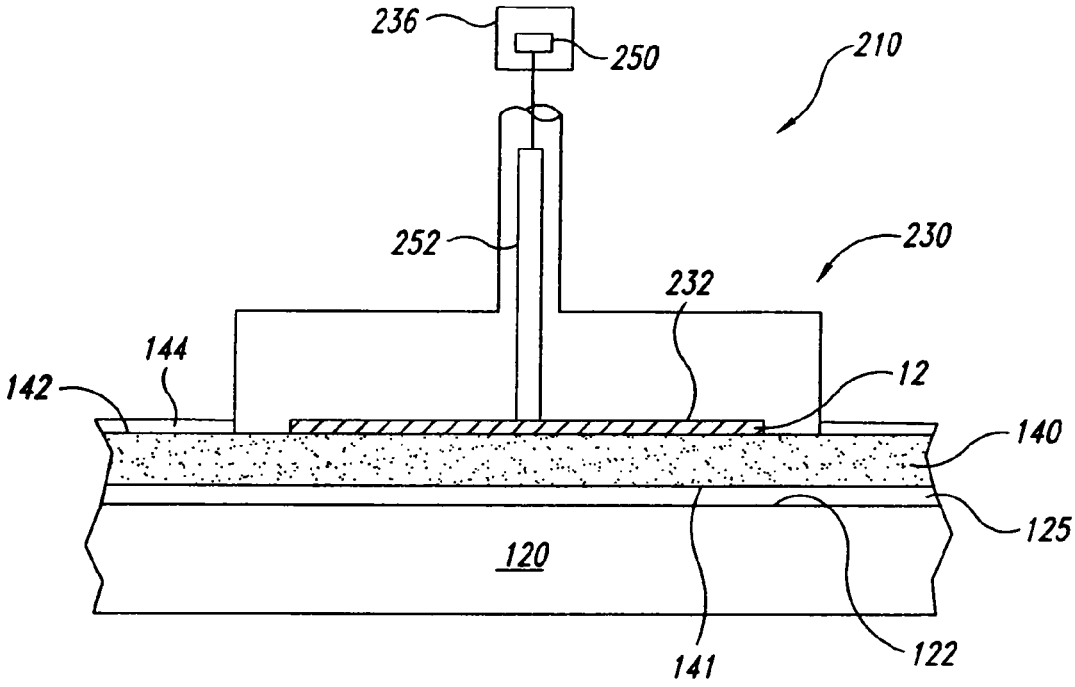
FIG. 3 is a schematic view of a machine for removing material from a microfeature workpiece in accordance with another embodiment of the invention.

FIG. 3 is a schematic view of a machine 210 in accordance with another embodiment of the invention. The machine 210 includes the support 120 and the fixed-abrasive medium 140 of the machine 110 described above with reference to FIG. 2. The machine 210 also includes a head 230 coupled to an actuator assembly 236 to move the head 230. The head 230 has a lower surface 232 to which the workpiece 12 can be attached. The actuator assembly 236 includes an actuator 250 that can be a transducer that vibrates, oscillates, or otherwise moves the workpiece 12 relative to the fixed-abrasive medium 140. The actuator 250 can be similar to the actuator 150 described above with reference to FIG. 2, and a rod 252 extending from the actuator 250 to the lower surface 232 of the head 230 can transmit the output from the actuator 250 to the workpiece 12. In other embodiments, the actuator 250 and the rod 252 can vibrate the head 230 and the workpiece 12 together.

Figure 4:
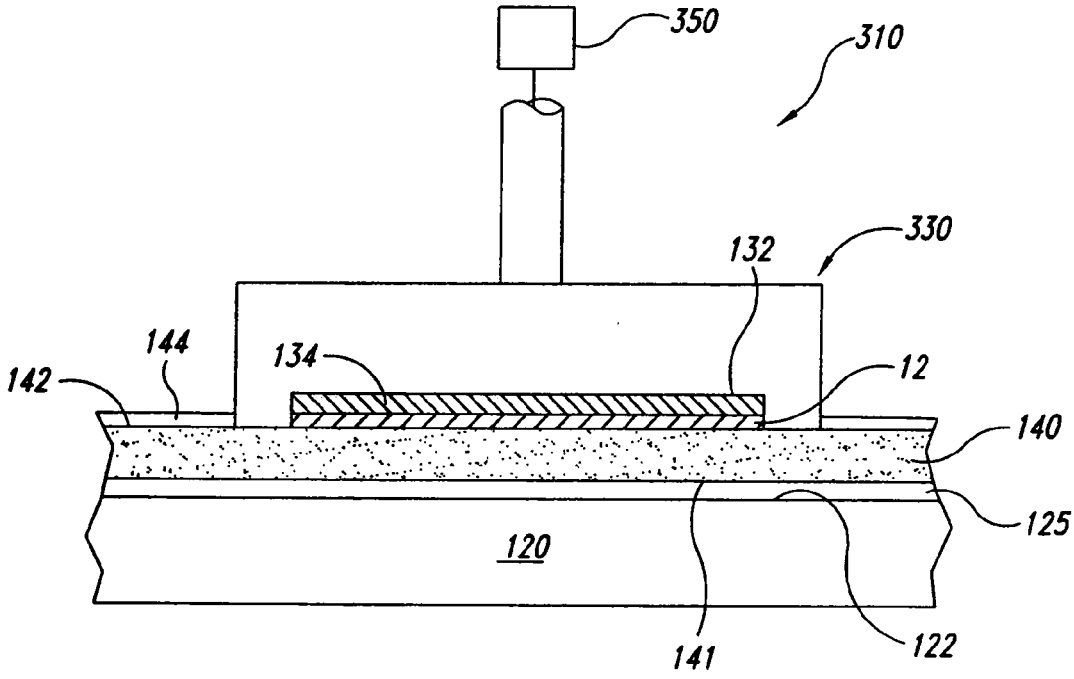
FIG. 4 is a schematic view of a machine for removing material from a microfeature workpiece in accordance with another embodiment of the invention.

FIG. 4 is a schematic view of a machine 310 having a head 330 and an actuator 350 in accordance with another embodiment of the invention. In the illustrated embodiment, the actuator 350 is a transducer or lift mechanism that otherwise controls the down-force applied to the workpiece 12 via the head 330. The actuator 350 can be coupled to a controller having computer-operable instructions that cause the actuator 350 to impart the desired relative motion between the workpiece 12 and the fixed-abrasive medium 140 as set forth above.

Figure 5:
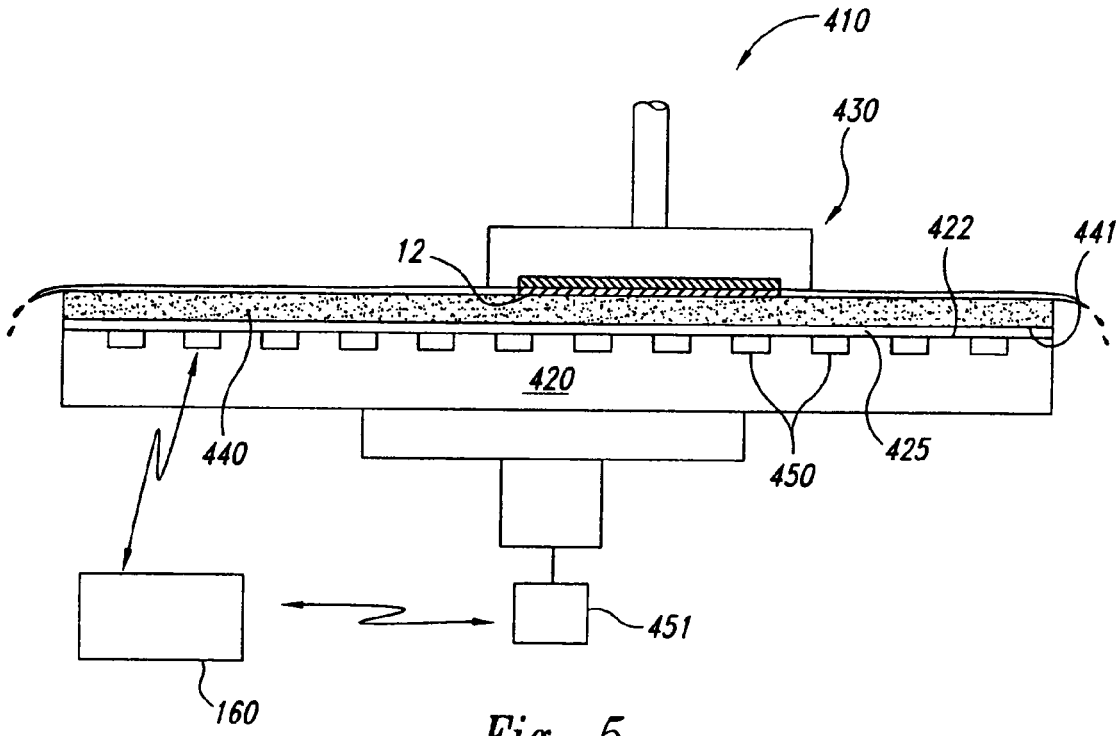
FIG. 5 is a schematic view of a machine for removing material from a microfeature workpiece in accordance with another embodiment of the invention.

FIG. 5 is a schematic view of a machine 410 that includes a support 420, a head 430, and a fixed-abrasive medium 440 in accordance with another embodiment of the invention. The machine 410 may also have an under-pad 425 between an upper surface 422 of the support 420 and a lower surface 441 of the fixed-abrasive medium 440. In the illustrated embodiment, the support 420 includes a plurality of actuators 450 proximate to the upper surface 422. Each actuator 450 is configured to move the fixed-abrasive medium 440 relative to the workpiece 12. In additional embodiments, the actuators 450 may be positioned in the fixed-abrasive medium 140 or between the support 420 and the fixed-abrasive medium 440. The actuators 450 may be transducers that are operated by a controller 160 to vibrate, oscillate, or otherwise impart the desired relative motion between the fixed-abrasive medium 440 and the workpiece 12 as described above with reference to FIG. 2.

Referring still to FIG. 5, an alternative embodiment of the machine 410 can include an actuator 451 attached to the support 420 to lift or otherwise vibrate the entire support 420 in a manner that controls the force applied to the workpiece 12. The actuator 451 can also be operatively coupled to the controller 160 so that the computer-operable medium can control the actuator 451 as described above.

Figure 6:
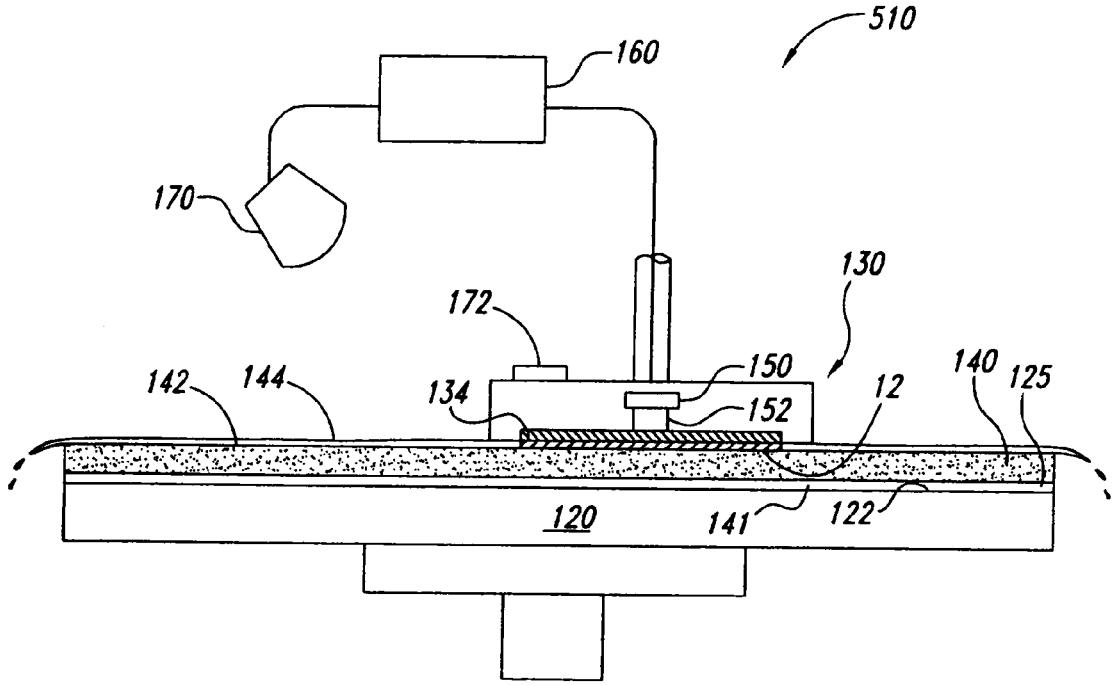
FIG. 6 is a schematic view of a machine for removing material from a workpiece in accordance with another embodiment of the invention.

FIG. 6 is a schematic view of a machine 510 for removing material from a workpiece 12 in accordance with another embodiment of the invention. The support 120, head 130, fixed-abrasive medium 140, and actuator 150 are similar to those described above with reference to FIG. 2, and thus like reference numbers refer to like components in FIGS. 2 and 6. The machine 510 further includes a sensor configured to sense a parameter indicative of the frictional force at the interface between the workpiece 12 and the bearing surface 142 of the fixed-abrasive medium 140. The sensor, for example, can be a detector configured to measure the velocity of the head, the relative velocity between the head and the fixed-abrasive medium 140, vibrations of the head or the fixed-abrasive medium, and/or deceleration of the head 130. One embodiment of a sensor comprises an optical sensor 170 operatively coupled to the controller 160 for determining the velocity of the head 130. Another embodiment of the sensor comprises an accelerometer 172 attached to the head 130 and operatively coupled to the controller 160 for determining the acceleration of the head 130. In still another embodiment, the sensor can comprise several motors that operate the support 120 and the head 130 and have encoders that provide feedback regarding the positions and velocities of the support 120 and head 130 to the controller 160. Another embodiment of a sensor is a Doppler Vibrometer that maps out-of-plane vibrations while measuring in-plane motion. The sensors accordingly measure the velocity, relative velocity, vibrations, and/or deceleration of the head 130 and/or the fixed-abrasive medium 140 in a manner that detects a parameter indicative of the frictional force between the workpiece 12 and the surface 142 of the fixed-abrasive medium 140.

The machine 510 is used in several methods for removing material from a workpiece 12. One embodiment of such a method comprises detecting at least one of the relative velocity between the workpiece 12 and the fixed-abrasive medium 140, the acceleration of the head 130, and/or vibrations of the head 130. This embodiment can further include controlling the actuator 150 to maintain the movement between the workpiece 12 and the fixed-abrasive medium 140 within a desired range. For example, the controller 160 can vibrate the interface between the workpiece 12 and the surface 142 of the fixed-abrasive medium 140 when the sensor indicates (a) that deceleration of the head 130 exceeds a deceleration limit, (b) that the relative velocity between the workpiece 12 and the fixed-abrasive medium 140 is below a desired limit, and/or (c) the out-of-plane vibrations of the head 130 exceed a limit. The machine 510 is accordingly expected to provide better control of the motion between the workpiece 12 and the fixed-abrasive medium 140 based on the parameter detected by the sensors. It will be appreciated that only one sensor is needed for the machine 510, but any number of similar or different sensors can be used in combination as well.

Figure 7:
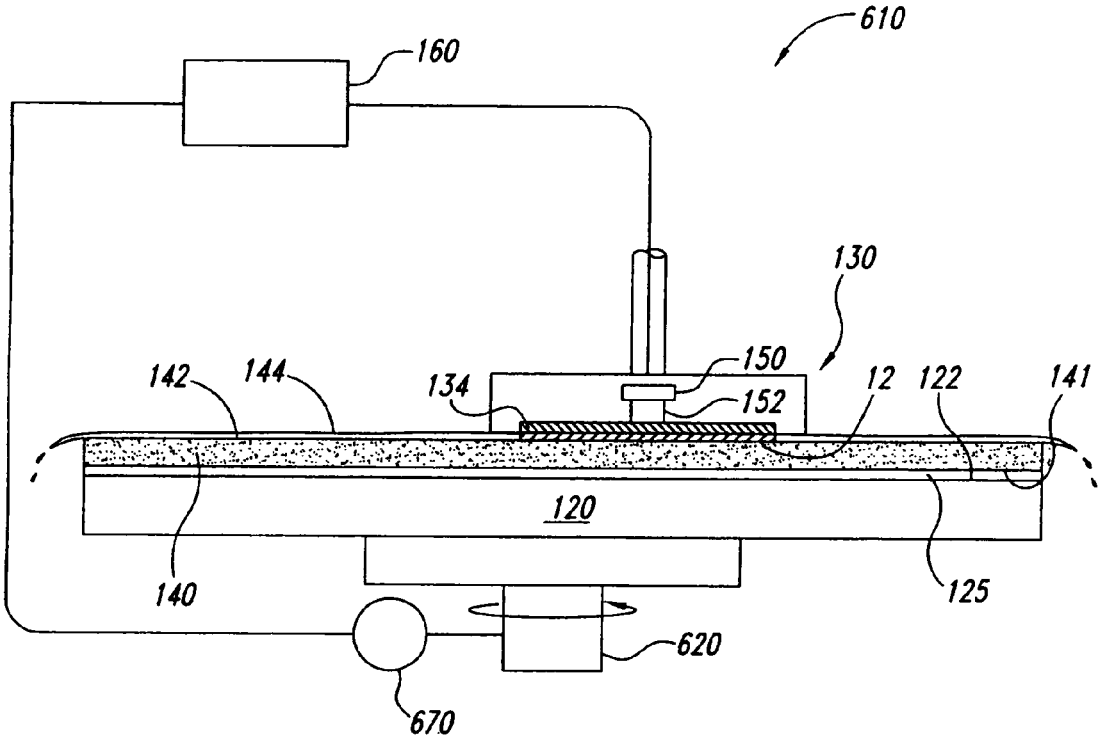
FIG. 7 is a schematic view of a machine for removing material from a microfeature workpiece in accordance with another embodiment of the invention.

FIG. 7 illustrates a machine 610 for removing material from a workpiece 12 in accordance with another embodiment of the invention. The machine 610 is similar to the machine 110 illustrated in FIG. 2, and thus like reference numbers refer to like components in FIGS. 2 and 7. The machine 610 further includes a drive assembly 620 that rotates or otherwise moves the support 120 and a sensor 670 coupled to the controller 160 and the drive assembly 620. The sensor 670 can be a current meter that measures the load on the drive assembly 620. In operation, as the frictional force between the substrate 12 and the fixed-abrasive medium 140 changes, the current drawn by the drive assembly 620 changes in proportion to the load. The sensor 670 accordingly measures the changes in current drawn by the drive assembly and sends corresponding signals to the controller 160 for operating the actuator 150. The controller 160 can operate the actuator to vibrate the workpiece 12 or otherwise move the head 130 and/or fixed-abrasive medium 140 to modulate the load measured by the sensor.

Figure 8:
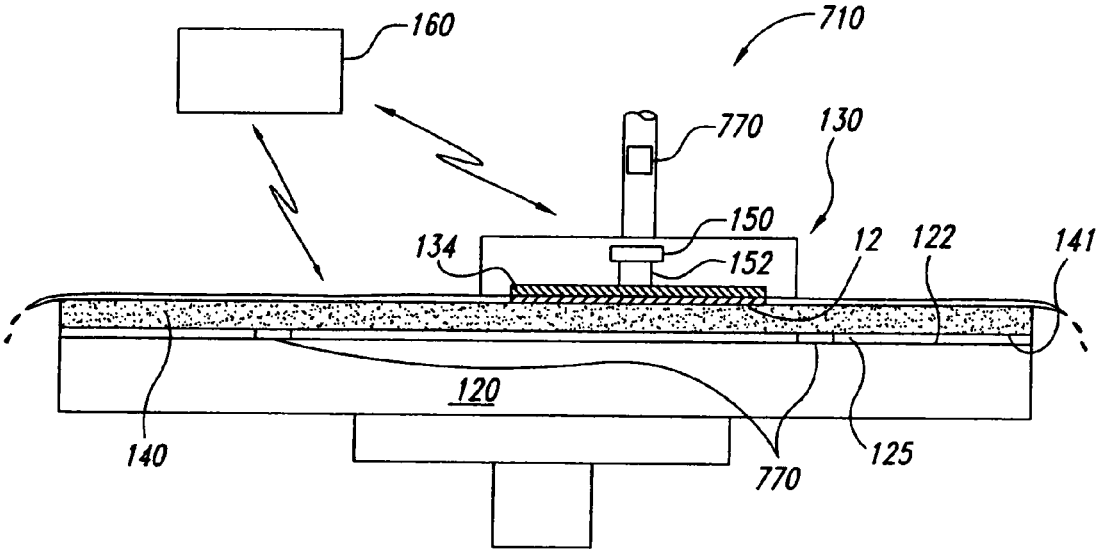
FIG. 8 is a schematic view of a machine for removing material from a microfeature workpiece in accordance with another embodiment of the invention.

FIG. 8 schematically illustrates a machine 710 in accordance with still another embodiment of the invention. The machine 710 is similar to the machine 110 illustrated in FIG. 2, and thus like reference numbers refer to like components in FIGS. 2 and 8. In this embodiment, the machine 710 includes at least one strain sensor 770 attached to the head 130 and/or the fixed-abrasive medium 140 for measuring the strain in the head 130 and/or the fixed-abrasive medium 140. For example, one strain sensor 770 can be attached to the head 130 and/or a plurality of strain sensors 770 can be attached to the support 120 and the backside 141 of the fixed-abrasive medium 140. In operation, the strain sensors 770 detect changes in the frictional force between the workpiece 12 and the fixed-abrasive medium 140. Based on the detected changes in the frictional force between the workpiece 12 and the fixed-abrasive medium 140, the controller 160 operates the actuator 150 to impart the desired relative motion between the workpiece 12 and the fixed-abrasive medium 140. Therefore, the machine 710 is expected to provide many of the same advantages of the machine 110, and the machine 710 is further expected to provide enhanced control of the movement of the workpiece 12 across the surface 142 of the fixed-abrasive medium 140 based on the feedback provided by the sensors 770.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

I claim:

1. A system for removing material from a microfeature workpiece, comprising:

a support;

a fixed-abrasive medium having a matrix, a surface configured to contact the workpiece, and abrasive particles attached to the matrix at the surface, wherein the fixed-abrasive medium is on the support;

a head configured to rub a microfeature workpiece against the surface of the fixed-abrasive medium;

an actuator operatively coupled to at least one of the support, the fixed-abrasive medium, and the head, the actuator being configured to generate vibration of an interface between the microfeature workpiece and the surface of the fixed-abrasive medium; and a controller coupled to the actuator, wherein the controller comprises a non-transitory computer-operable medium containing instructions that cause the actuator to generate vibration of the interface between the workpiece and the surface of the fixed-abrasive medium to maintain a frictional force between the workpiece and the surface in a desired range.

2. The system of claim 1 wherein the actuator comprises a piezoelectric transducer mounted within the head.

3. The system of claim 1 wherein the actuator comprises a piezoelectric transducer mounted in the head, and the system further comprises a rod for transmitting energy from the piezoelectric transducer to a workpiece.

4. The system of claim 1, further comprising a sensor configured to detect a parameter indicative of frictional force between the workpiece and the fixed-abrasive medium.

5. The system of claim 1, further comprising a sensor configured to detect the relative velocity between the workpiece and the fixed-abrasive medium.

6. The system of claim 1, further comprising a sensor configured to detect out-of-plane vibration of at least one of the head and the fixed-abrasive medium.

7. The system of claim 1, further comprising a sensor configured to detect a load on a motor driving one of the head or the fixed-abrasive medium.

8. A system for removing material from a microfeature workpiece, comprising:

a support;

a fixed-abrasive medium having a matrix, a surface configured to contact the workpiece, and abrasive particles attached to the matrix at the surface, wherein the fixed-abrasive medium is on the support;

a head configured to rub a microfeature workpiece against the surface of the fixed-abrasive medium;

an actuator operatively coupled to at least one of the support, the fixed-abrasive medium, and the head, the actuator being configured to generate oscillation of an interface between the microfeature workpiece and the surface of the fixed-abrasive medium; and a controller coupled to the actuator, wherein the controller comprises a non-transitory computer-operable medium containing instructions that cause the actuator to generate oscillation of the interface between the microfeature workpiece and the fixed-abrasive medium to control a frictional force at the interface between the workpiece and the fixed-abrasive medium.

9. The system of claim 8 wherein the actuator comprises a piezoelectric transducer mounted within the head.

10. The system of claim 8 wherein the actuator comprises a piezoelectric transducer mounted in the head, and the system further comprises a rod for transmitting energy from the piezoelectric transducer to a workpiece.

11. The system of claim 8, further comprising a sensor configured to detect a parameter indicative of frictional force between the workpiece and the fixed-abrasive medium.

12. The system of claim 8, further comprising a sensor configured to detect the relative velocity between the workpiece and the fixed-abrasive medium.

13. The system of claim 8, further comprising a sensor configured to detect out-of-plane vibration of at least one of the head and the fixed-abrasive medium.

14. The system of claim 8, further comprising a sensor configured to detect a load on a motor driving one of the head or the fixed-abrasive medium.

15. A system for removing material from a microfeature workpiece, comprising:

a support;

a fixed-abrasive medium having a matrix, a surface configured to contact the workpiece, and abrasive particles attached to the matrix at the surface, wherein the fixed-abrasive medium is on the support;

a head configured to rub a microfeature workpiece against the surface of the fixed-abrasive medium;

an actuator operatively coupled to at least one of the support, the fixed-abrasive medium, and the head, the actuator being configured to generate vibration of an interface between the microfeature workpiece and the surface of the fixed-abrasive medium;

a sensor configured to sense a parameter related to frictional force at the interface between the microfeature workpiece and the surface of the fixed-abrasive medium; and a controller coupled to the actuator, wherein the controller comprises a non-transitory computer-operable medium containing instructions that cause the actuator to generate vibration of the interface between the microfeature workpiece and the fixed-abrasive medium in a direction transverse to the interface based on the parameter.

16. The system of claim 15 wherein the actuator is a piezoelectric transducer.

17. The system of claim 15 wherein the head comprises a chuck and a backing member in the chuck, and wherein the actuator is mounted in the chuck and configured to move the backing member.

18. The system of claim 15 wherein the actuator comprises a piezoelectric transducer in the support that is configured to move the fixed-abrasive medium.

19. The system of claim 15 wherein the actuator comprises a lift system operatively coupled to the head, and wherein the lift system is configured to move the head to control the down-force applied to the workpiece.

20. The system of claim 15 wherein the actuator comprises a lift system operatively coupled to the support, and wherein the lift system is configured to move the support to control pressure at an interface between the workpiece and the surface of the fixed-abrasive medium.

21. The system of claim 15 wherein the sensor comprises a detector configured to measure a relative velocity between the head and the fixed-abrasive medium.

22. The system of claim 21 wherein the detector comprises at least one of an optical velocity sensor and an accelerometer.

23. The system of claim 15 wherein the detector comprises a load sensor configured to sense the frictional force.

24. The system of claim 23 wherein the load sensor comprises a strain sensor attached to the head to measure strain induced in the head from an interface between the workpiece and the fixed-abrasive medium.

25. The system of claim 23 wherein the load sensor comprises a current meter configured to measure electrical current through a motor that drives one of the head, the support, or the fixed-abrasive medium.

26. The system of claim 15 wherein the instructions of the computer-operable medium cause the actuator to vibrate the workpiece in a manner that maintains the sensed parameter in a desired range.

27. The system of claim 15 wherein the instructions of the computer-operable medium cause the actuator to oscillate the workpiece when the sensed parameter exceeds a limit.

28. The system of claim 15 wherein the instructions of the computer-operable medium cause the actuator to reduce a down-force applied to the workpiece when the sensed parameter exceeds a limit.

* * * * *